US007611275B2

(12) United States Patent
Crespo

(10) Patent No.: US 7,611,275 B2
(45) Date of Patent: Nov. 3, 2009

(54) PORTABLE CEMENT MIXING AND DISPENSING ASSEMBLY

(76) Inventor: Pedro R. Crespo, 4495 E. 11$^{th}$ Ave., Hialeah, FL (US) 33013

( * ) Notice: Subject to any disclaimer, the term of this patent is extended or adjusted under 35 U.S.C. 154(b) by 316 days.

(21) Appl. No.: 11/818,250

(22) Filed: Jun. 14, 2007

(65) Prior Publication Data

US 2008/0310250 A1 Dec. 18, 2008

(51) Int. Cl.
*B28C 5/14* (2006.01)
*B28C 7/16* (2006.01)

(52) U.S. Cl. ..... 366/50; 366/64; 366/186; 366/192

(58) Field of Classification Search ..... 366/42, 366/50, 64, 66–67, 96–99, 186, 194–196, 366/189, 192, 318–324
See application file for complete search history.

(56) References Cited

U.S. PATENT DOCUMENTS 4,778,276 A * 10/1988 Meyer et al. ..... 366/319
5,609,416 A * 3/1997 Duckworth ..... 366/64
5,624,183 A * 4/1997 Schuff ..... 366/66
6,666,573 B2 * 12/2003 Grassi ..... 366/50

FOREIGN PATENT DOCUMENTS

JP 2006-175739 A * 7/2006
WO 95/28229 A1 * 10/1995
WO 2009/030999 A1 * 3/2009

* cited by examiner

*Primary Examiner*—Charles E Cooley

(57) ABSTRACT

A portable assembly for mixing water with cement powder and dispensing produced paste into a predetermined area, comprising a removable mixer assembly including an elongated mixing shaft, means for generating and transmitting a rotational motion to the mixer assembly, an uprightly supported mixing body having a mixing chamber including an upper opening and inner space for the water and dry cement to be mixed and homogenized inside thereof and aided by the mixing shaft. Also including a discharging mechanism having fixed and movable grip members to be manually actuated, than in turn actuate a spring assembly and releases a closure member to permit the mixed homogenized paste to flow out of the mixing chamber. The discharging mechanism further includes a guiding plate assembly to prevent the over spillage of the produced cement paste and guide the discharging flow out directly into the selected area.

6 Claims, 9 Drawing Sheets

10
20
21
22
23
24
26
28
30
31
32
33
34
35
36
37
38
39
40
41
42
43
44
45
45'
46
47
48
50
60
70
71
72
73
74
75
8
32'

PORTABLE CEMENT MIXING AND DISPENSING ASSEMBLY

BACKGROUND OF THE INVENTION

1. Field of the Invention

The present invention relates to an assembly having dual function of both mixing and dispensing cement paste into a predetermined area, and more particularly to the type, that is portable and preferably used in construction.

2. Description of the Related Art

Apparatuses for mixing cement powder with water or the combination of both mixing and dispensing cement of various types have been known for many years and used in the construction and dental industries. However, I believe that none of them includes the specific features of the present invention. I disclose a convenient, portable and comfortable assembly that includes a motorized mixer, housed within a mixing chamber, for mixing cement and a manually operated discharging mechanism for dispensing cement paste into a predetermined area. Also, this invention is designed for use in those areas where small quantities of mix concrete is needed and the cleanliness is highly required. The most commonly used method for mixing small amount of cement in the construction field nowadays is the preparation of the liquefied cement mix in a reservoir by inserting a manually or electrically operated mixer, then the resultant paste is dispensed into the desired spot by a pouring tool. This reservoir usually becomes heavy, therefore has to be placed next to the application site and later be disposed. The disclosed invention overcomes this shortcoming by providing a user with a transportable apparatus that mixes and produces liquefied cement mix while dispensing the latter into the desired area. Once its usage is finished, the user cleans the interior and all the disassembling members with clean water and the apparatus is ready to be used again.

SUMMARY OF THE INVENTION

It is one of the main objects of the present invention to provide an assembly that includes three main pieces that, when assembled, form an apparatus for mixing dry cement powder with water and dispensing the produced cement mix.

It is another object of this invention to provide an assembly that is used for mixing and dispensing small quantities of cement paste of the type that dries fast and requires immediate manipulation.

It is another object of this invention to provide an assembly that can be used where limitation of working space is an issue.

It is another object of this invention to provide an assembly that is portable.

It is another object of this invention to provide an assembly that is easy to use and manipulate.

It is another object of this invention to provide an assembly that has such a discharging mechanism that dispenses the cement mix directly into the desired area without pouring out any cement paste residue, therefore maintaining the cleanliness of the working spot.

It is another object of this invention to provide an assembly that has such a mixing mechanism producing more homogeneous mix in less period of time than manually operated mixers commonly used in construction field.

It is still object of this invention to provide an assembly that is easy to disassemble for cleaning purposes and reusable.

It is yet another object of this invention to provide such a device that is inexpensive to manufacture and maintain while retaining its effectiveness.

Further objects of this invention will be brought out in the following part of the specifications, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
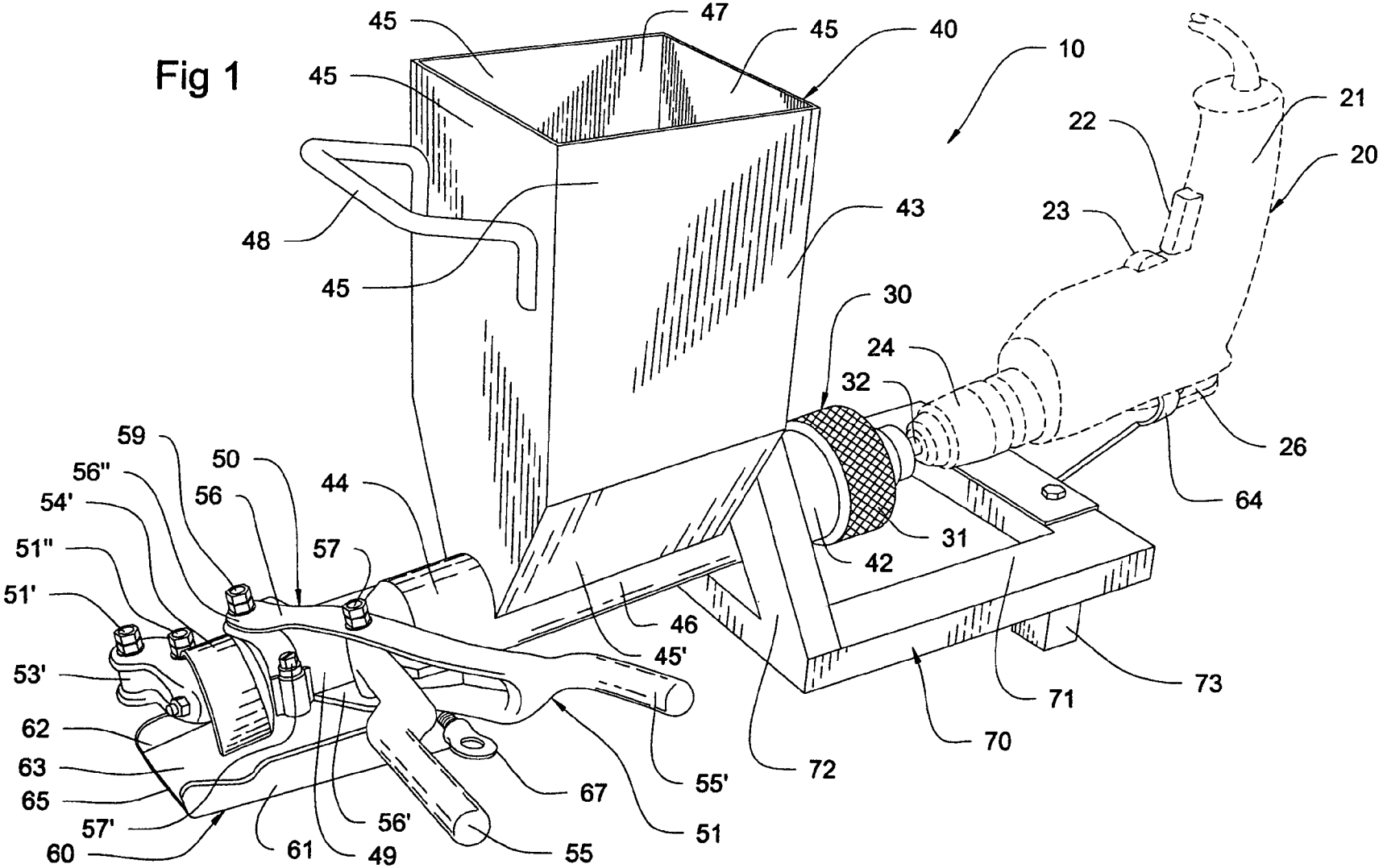
FIG. 1 is an isometric view from the top of the present invention.

Referring to the drawings in detail and initially to FIG. 1 thereof, it will be seen that assembly 10 basically includes screwdriver member 20, removable mixer assembly 30, mixing body 40 and discharging mechanism 50.

Figures 6, 7, 8:
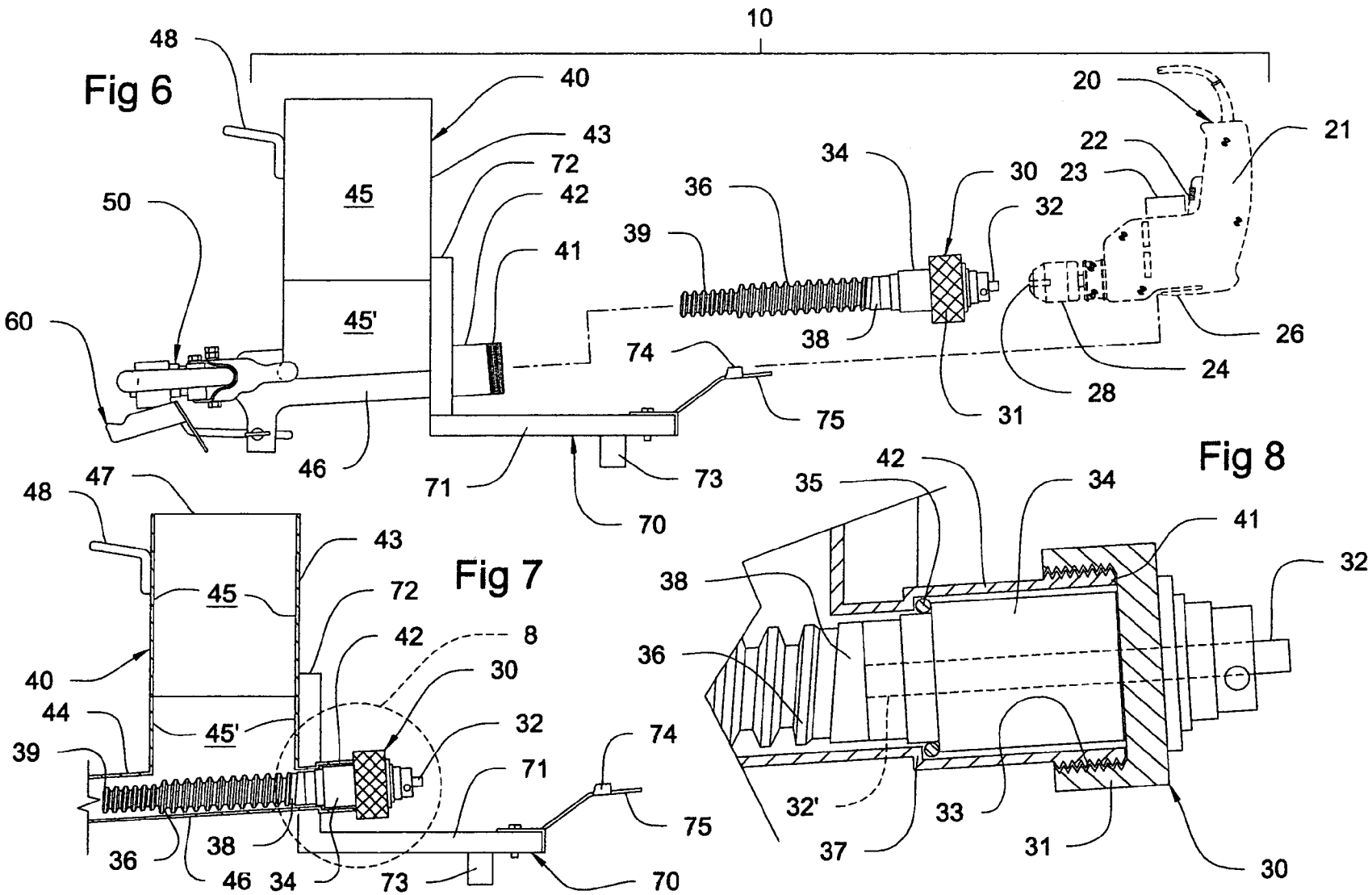
FIG. 6 is an elevational exploded view of the preferred embodiment shown in previous figures.
FIG. 7 is a partial cross-sectional view of a mixing chamber, taken along line 7-7 in FIG. 2, illustrating a mixing shaft of mixer assembly which is partially housed within the mixing chamber.
FIG. 8 is an enlarged view of the partial cross section previously shown and referred with numeral 8. This figure partially illustrates the internal connections between mixer assembly and tubular inlet of mixing body.

Screwdriver 20 is a well known hand tool and it is not part of the invention, however in the preferred embodiment is used as a motion energy supplier for mixer assembly 30, which may operate by electrical power or battery. Screwdriver 20, basically includes handle body 21, trigger member 22, switch 23, rotator 24 and projecting tab 26. As shown in FIG. 6, rotator 24 has inner cavity 28 to cooperatively and snugly receive connecting rotating rod 32 of mixer assembly 30. In this manner, rotating rod 32 receive and transmit the rotational motion to mixer assembly 30.

Mixer assembly 30, in the preferred embodiment, basically includes annular housing 31, connecting rotating rod 32, body 34 and elongated mixing shaft 36. As best seen in FIGS. 6, 7 and 8, annular housing 31 has inner threaded cavity 33 to cooperatively receive outer threaded opening end 41 of tubular inlet 42. In this manner, mixer assembly 30 is secured in placed to mixer body 40. Connecting rotating rod 32 is partially housed inside fixed lubricate oil body 34, and rigidly connected at its other end 32' to end 38 of elongated mixing shaft 36. Thus, mixing shaft 36 receives the rotary motion imparted by screw driver 20. Elongated mixing shaft 36 has a helical screw type configuration and is designed to mix the supplied dry cement and water by its helicoidal motion driven by screw driver 20. O-ring 35 is positioned and sandwiched between step 37 and body 34. This is intended for sealing and preventing contamination of the liquefied cement mix with the lubricate oil of the rotating mechanism inside body 34. Elongated mixing shaft 36 also has distal 39.

Figure 2:
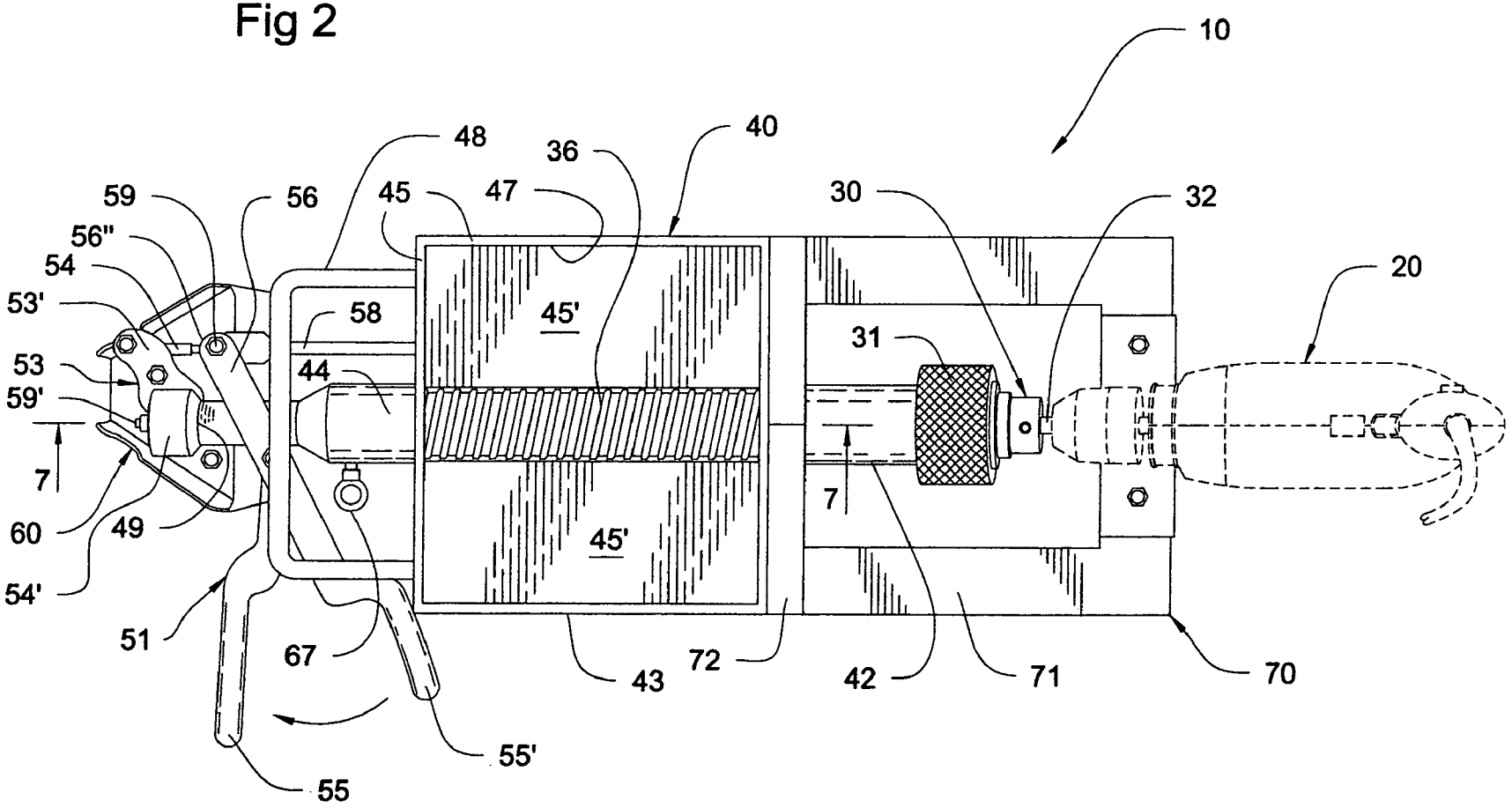
FIG. 2 is a top view of the present invention.

Mixing body 40, in the preferred embodiment, basically includes mixing chamber 43, tubular inlet 42 rigidly mounted to one bottom end of chamber 43 and tubular outlet 44 to the other opposite bottom end thereof. Elongated mixing shaft 36 is inserted into mixing body 40 through tubular inlet 42 and housed within mixing chamber 43. Distal end 39 of elongated mixing shaft 36 is housed within tubular outlet 44. Mixing chamber 43 uprightly extends and has an inner space defined by four lateral vertical walls 45, two slanted walls 45' and bottom wall 46. Bottom wall 46 has a C-shaped tubular configuration and provides enough space for mixing shaft 36 to freely rotate within. The uppermost edges of four lateral vertical walls 45 define upper opening 47, as best illustrated in FIGS. 1 and 2. Mixing chamber 43 also include handle 48 for a user to hold and transport apparatus 10 when the latter is not in use. Tubular inlet 42 and outlet 44 are perpendicularly disposed with respect to upright mixing chamber 43. Tubular outlet 44 also has tubular end 49 which has smaller diameter than the former as it is the conduit for the mixed cement paste to exit apparatus 10 that is in turn aided by manually operating discharging mechanism 50.

Figure 3:
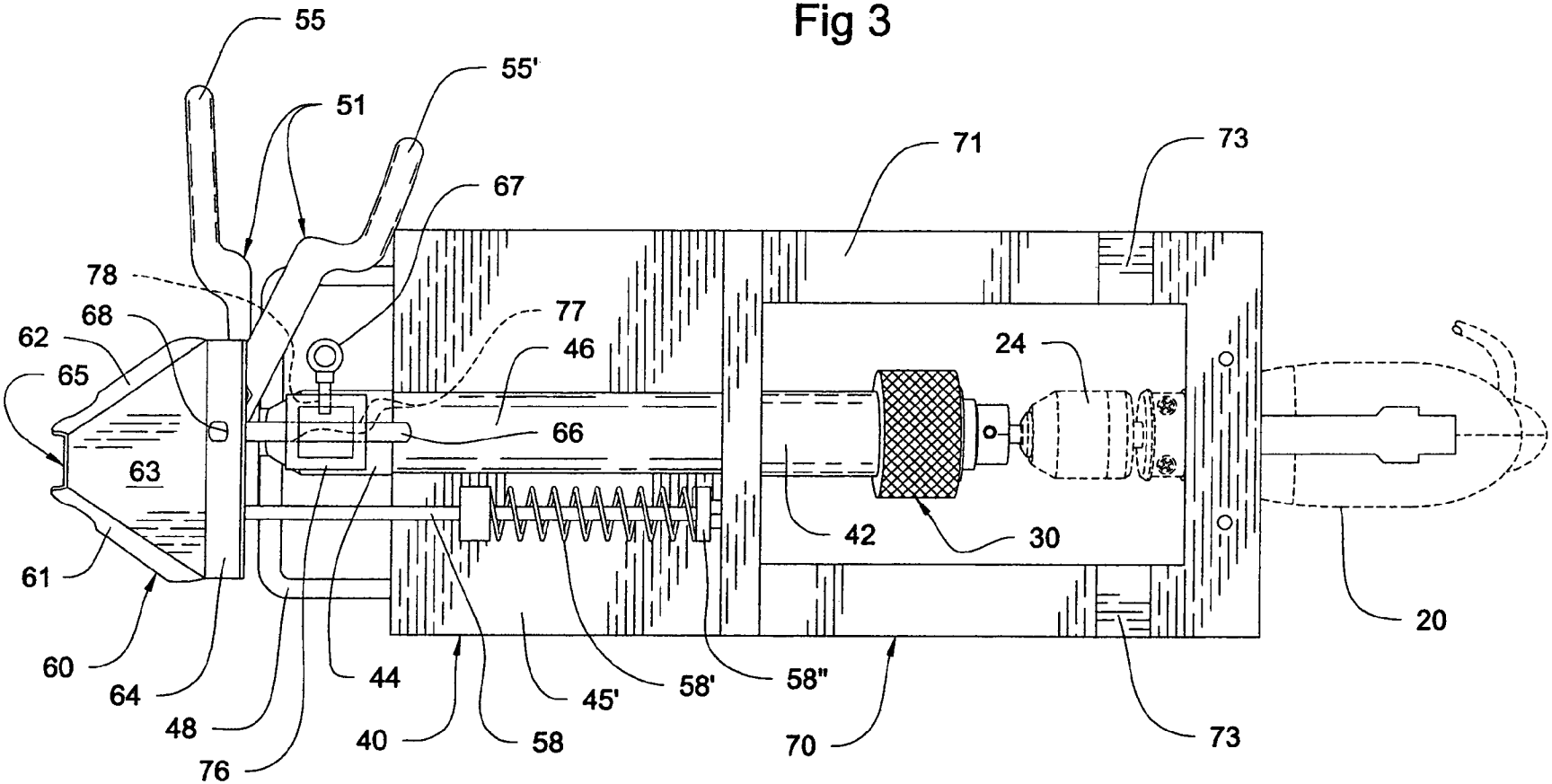
FIG. 3 is a bottom view of the present invention.
Figure 4:
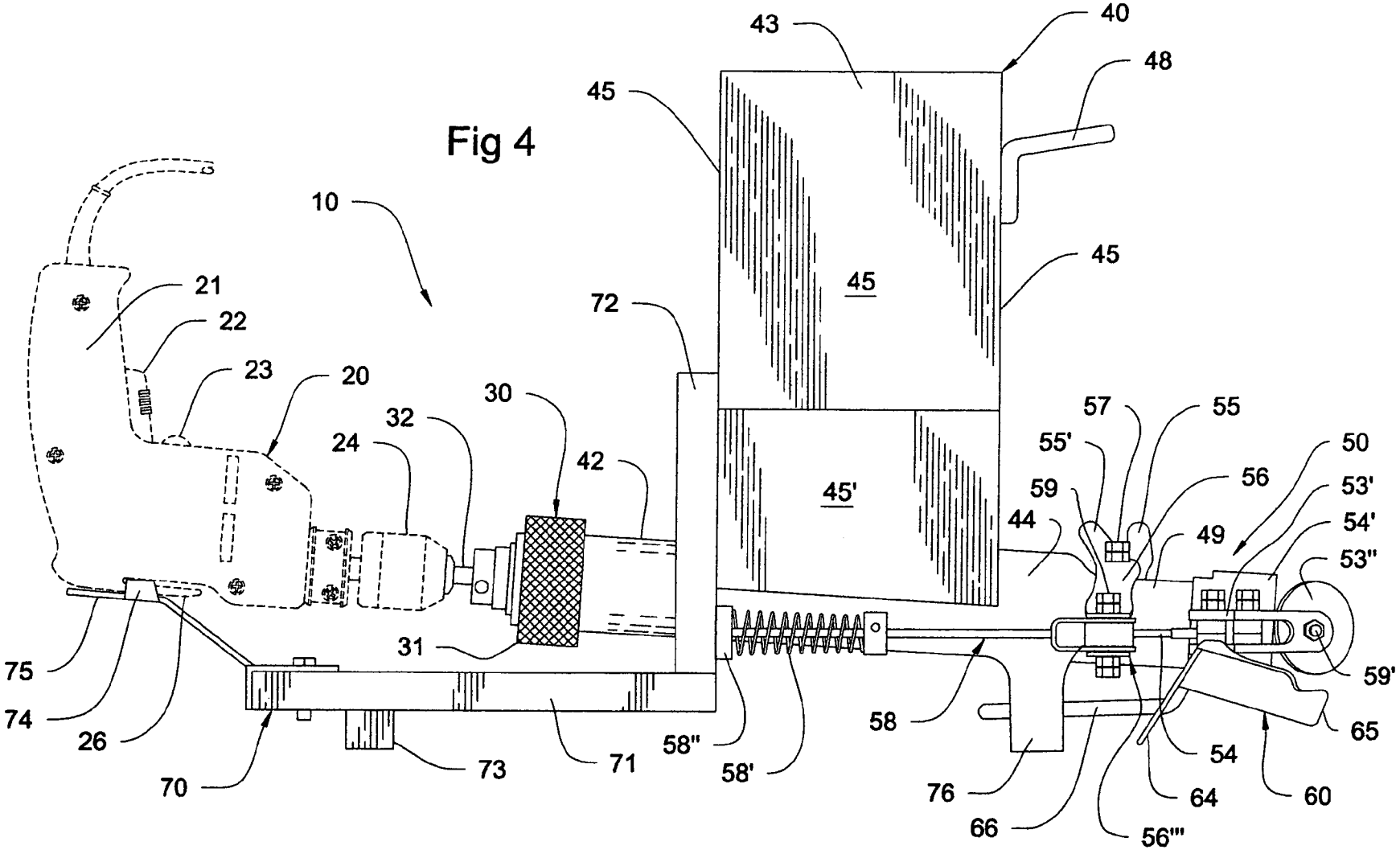
FIG. 4 is an elevational view of one side of this invention.
Figure 5:
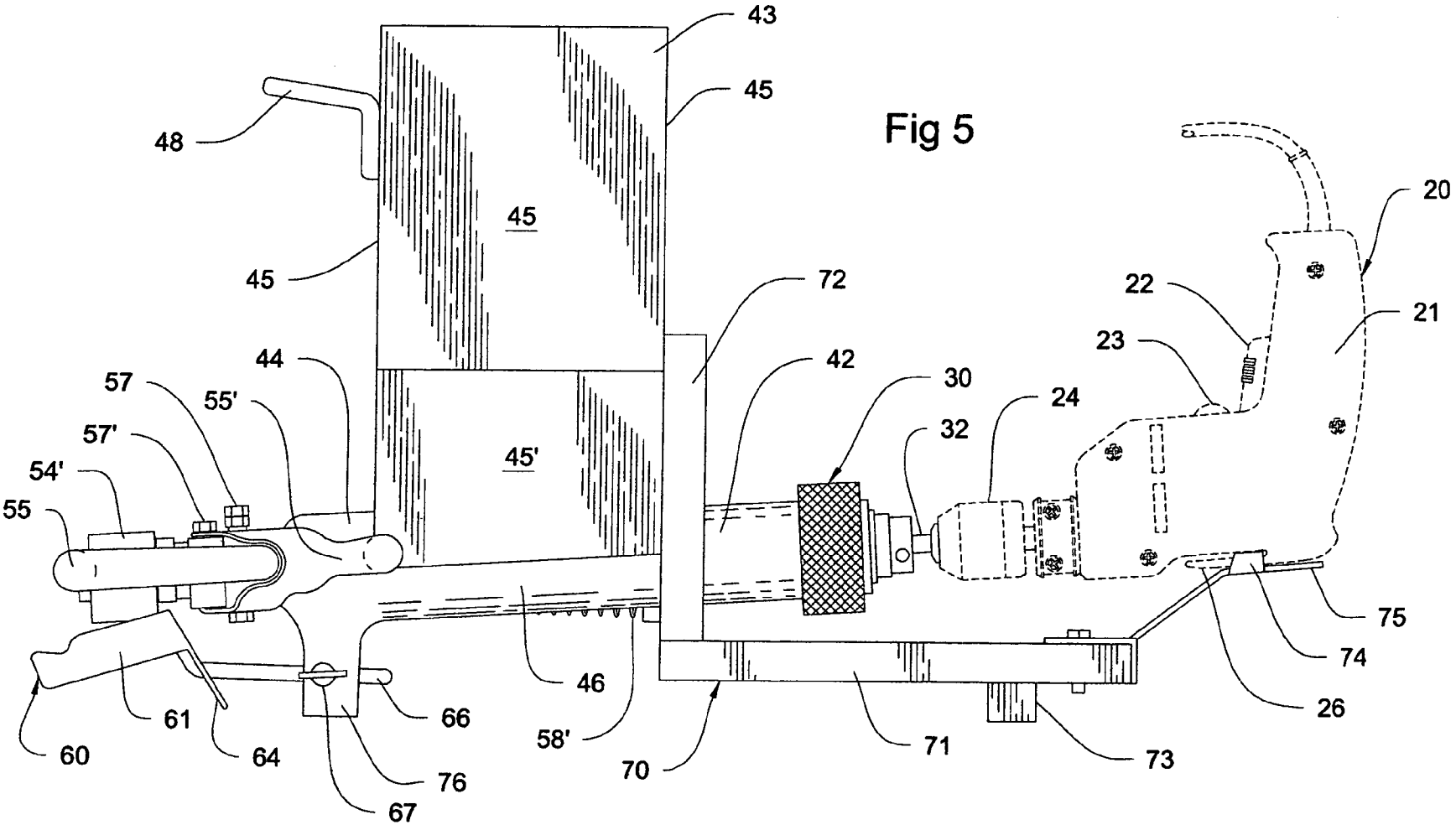
FIG. 5 is an elevational view of the opposite side of the previous figure.
Figure 9:
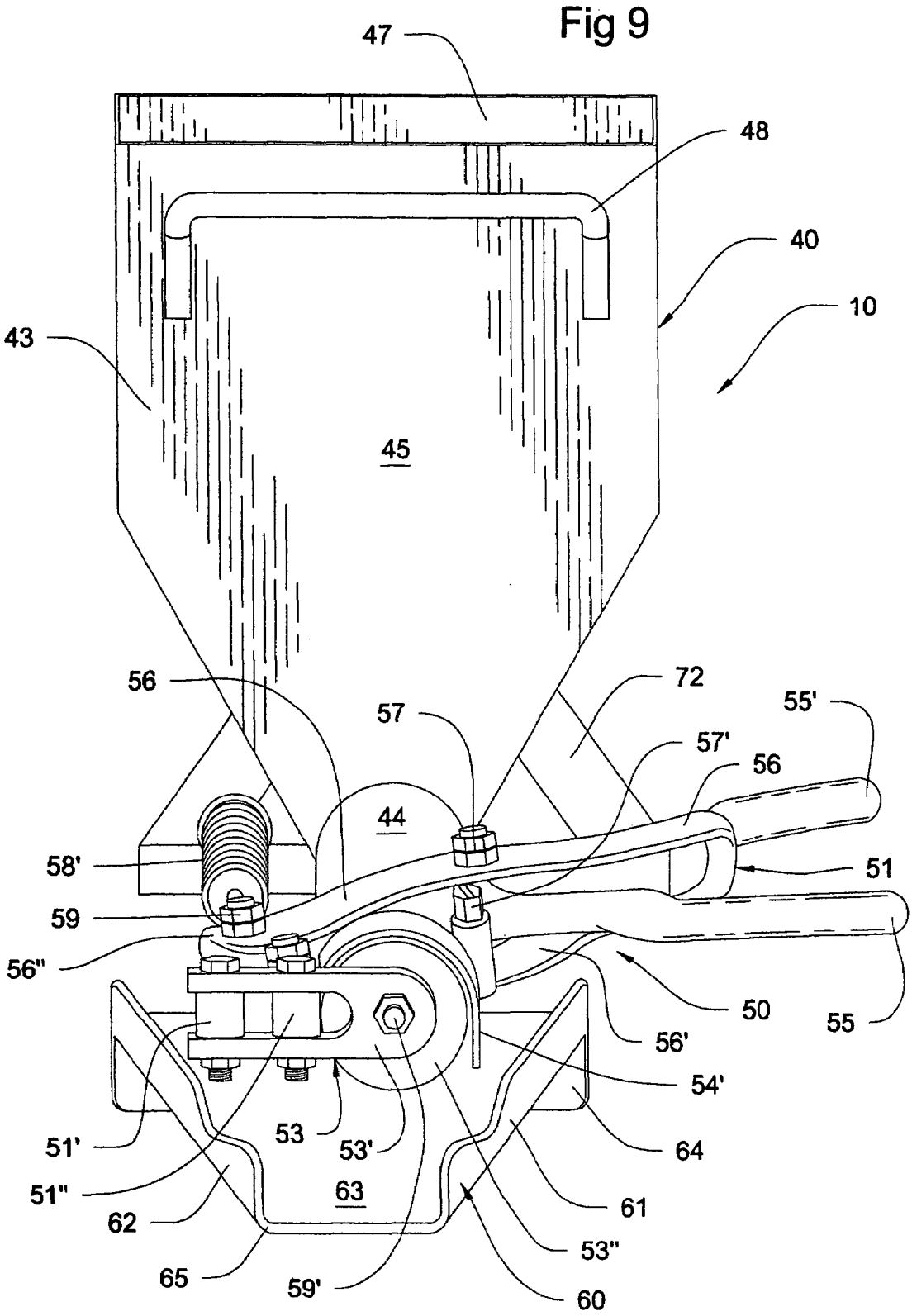
FIG. 9 is an elevational end view of the preferred embodiment, illustrating the material discharging mechanism.
Figure 10:
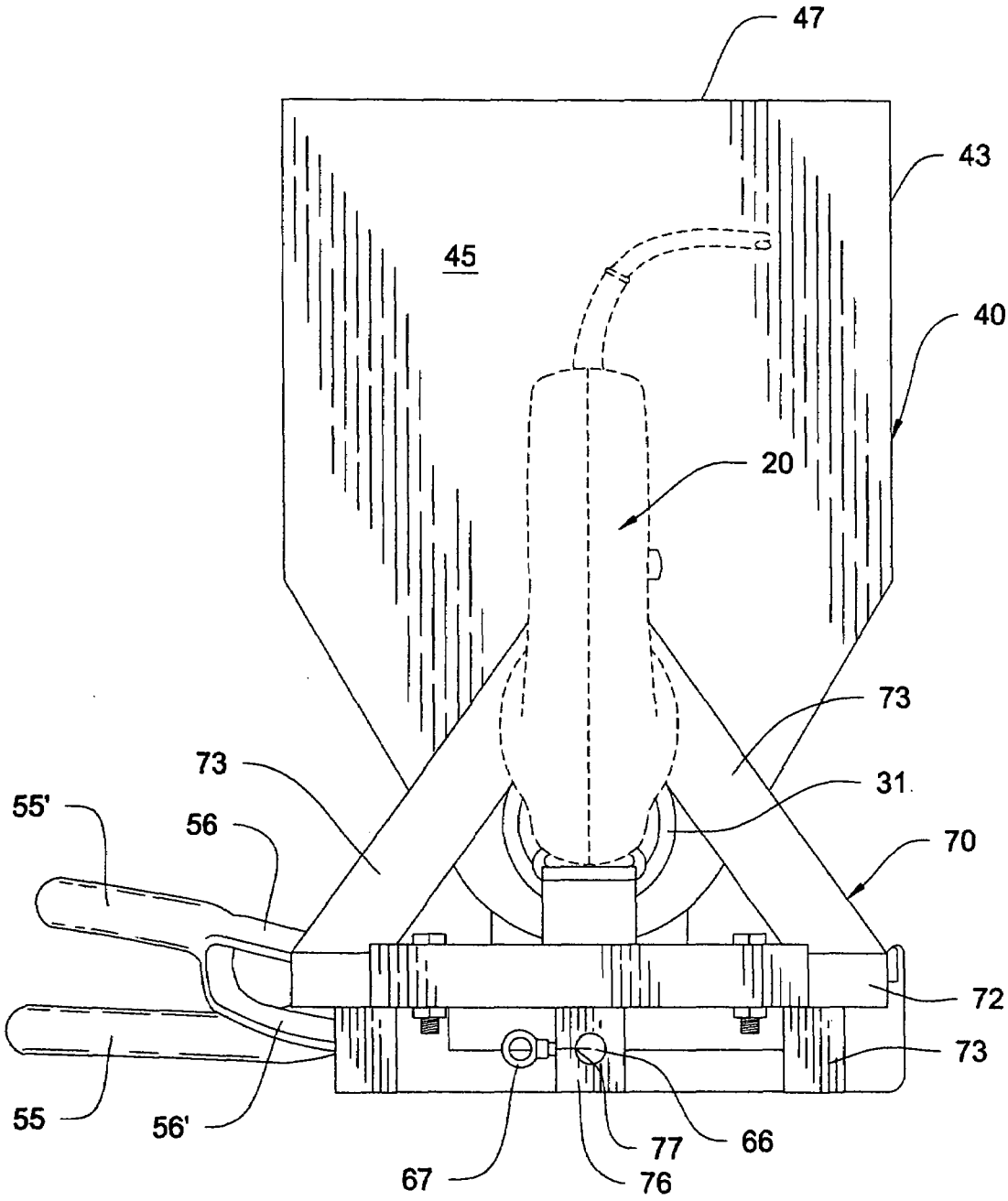
FIG. 10 is an elevational end view of the opposite side of the preferred embodiment, illustrating the screw driver as the motion source.
Figure 11:
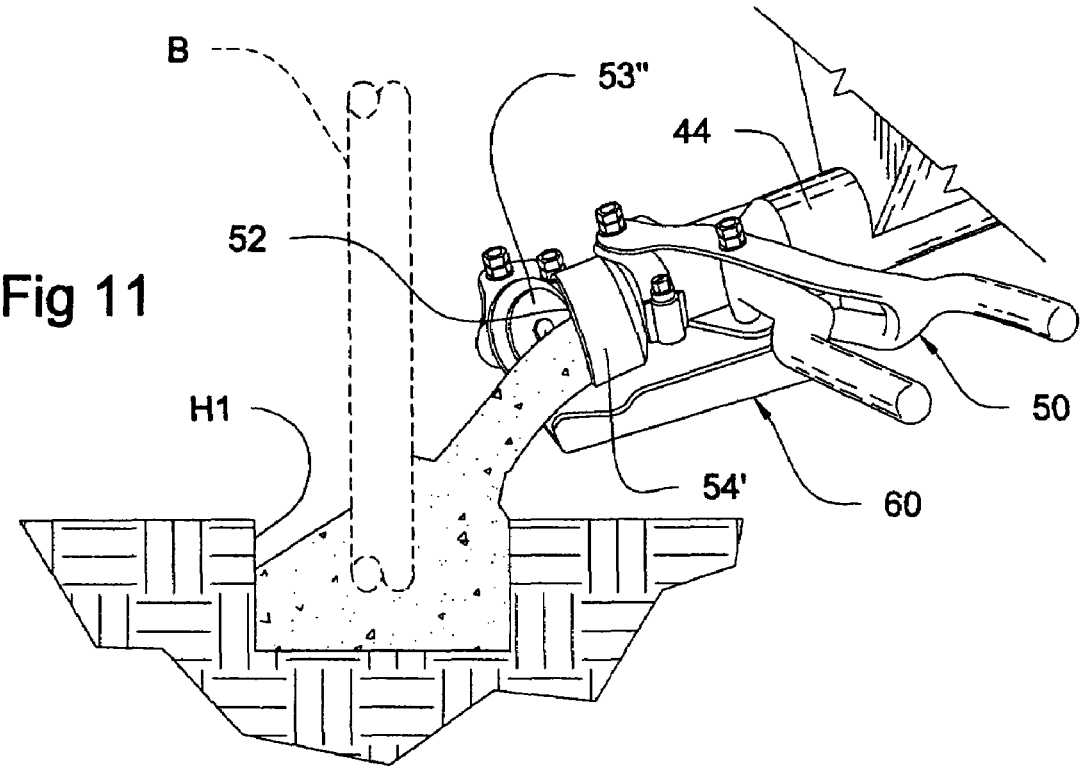
FIG. 11 illustrates an application of this invention, when the cement mix paste is being poured into a hole around the bar needed to be anchored in place.

Discharging mechanism 50, in the preferred embodiment, consists of actuating mechanism 51, discharge opening 52 with discharge closure assembly 53 and guiding plate assembly 60 removable mounted thereto. As seen in FIGS. 1, 2 and 3 actuating mechanism 51 has fixed and movable grip members 55 and 55', respectively, and kept together by screw and nuts set 57. Fixed grip member 55 is rigidly welded to tubular end 49. Movable grip member 55' includes elongated fork plates 56 and 56' firmly fastened around tubular end 49. Plate ends 56" and 56'" of elongated fork plates 56 and 56', respectively, are connected and fastened to spring rod assembly 58 by screw and nuts set 59, as best seen in FIGS. 4 and 9. Plate ends 56" and 56 '" also are connected and fastened to closure assembly 53 through connecting rod 54. Closure assembly 53 and spring rod assembly 58 are disposed in opposite directions with respect to plates ends 56" and 56 '". As best seen in FIGS. 3 and 4, spring rod assembly 58 has spiral-shaped spring 58' that is rigidly mounted to V-shaped supporting structure 72 by ending member 58". Closure assembly 53, as previously mentioned and illustrated in FIG. 2, is connected to actuating mechanism 51 by clamp member 53' that in turn is connected to rod 54. Closure member 53" is rigidly mounted to clamp member 53' and secured by screw and nut set 59'. Guiding cover 54' is placed over discharge opening 52 and closure member 53" to guide the exiting mixed cement paste and prevent a spill over. Furthermore, guiding plate 60 is adjustably mounted under tubular end or discharging port 49 to guide and reduce the cross sectional diameter of the cement paste flow into the desired area, as illustrated in FIG. 11.

Guiding plate 60, in the preferred embodiment, has a triangular configuration defined by lateral guiding walls 61 and 62, bottom wall 63 and rear wall 64. Lateral walls 61 and 62 prevent the over spillage of the produced cement paste and guide the flow out through mouth 65. Bottom wall 63 is at an angle of inclination with respect to a planar surface, and this is intended to aid the cement paste flow traveling down by gravity force. Rear wall 64 is also slanted with respect to a planar surface and has rod 66 rigidly mounted thereto. Rear wall 64 is also used as a supporting member for assembly 10 to rest on a planar surface. Rod 66 is configured for fixing removable guiding plate 60 into two holes 77 located across front sustaining foot member 76, as seen in FIG. 3. Rod 66 is designed is such manner that permits to adjust plate 60 farther or closer to the desired area. Then, adjusting pin 67 is inserted through threaded hole 78 and fastened by a user until rod 66 is secured in place to front foot member 76.

Mixing body 40 is horizontally and vertically supported with respect to a planar surface by structure 70. Structure 70, in the preferred embodiment, includes rectangular frame 71, V-shaped supporting bars 72, rear and front sustaining feet members 73 and 76, respectively. Rectangular frame 71 supports mixing chamber 43, at one end, and holding in place screwdriver 20 at the opposite end. Structure 70 has loop 74 rigidly mounted onto elongated tongue member 75, and is configured to cooperatively receive projecting tab 26 of screwdriver 20. In this manner, screwdriver 20 is kept in upright position and secured to mixer assembly 30 that in turn is secured to mixing body 40.

Assembly 10 is made out of aluminum material. This light weight material allows the user to transport and easily manipulate the device while using it.

OPERATION

Figure 12:
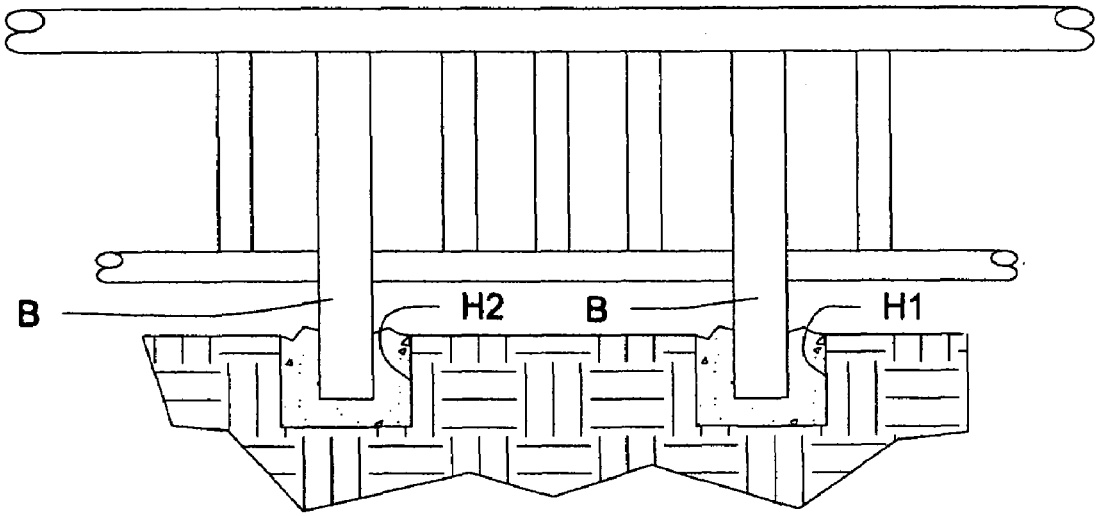
FIG. 12 illustrates an application of this invention, when a cement mix is needed in small constricted areas such as around balcony bars.

A user transports assembly 10 to the working site along with the dry cement to be used. The required proportion of dry powder cement and water is added to mixing chamber 43 through upper opening 47. A user turns on screwdriver member 20 by pressing trigger member 22. Screwdriver member 20 can be electrically or battery operated. Rotator 24 rotates transmitting the motion to connecting rod 32, which in turn transmits the rotary motion to elongated mixing shaft 36 inside mixing chamber 43. The supplied material starts mixing inside mixing chamber 43 with a circular movement up and down caused by the helical effect produced by screw-type mixing shaft 36. The user brings device 10 having guiding plate 60 close to the desired area that he/she wants to dispense the mixed cement paste to, as illustrated in FIG. 11. Then, the user actuates mechanism 51 by grasping movable grip 55' and bringing it towards fixed grip 55, as shown in FIG. 2. When movable grip 55' is brought towards fixed grip 55, elongated fork plates ends 56" and 56'" push spring rod 58 towards V-shaped supporting bars 72 and spring 58' is compressed, as best illustrated in FIG. 4. Simultaneously, connecting rod 54 pulls clamp member 53' pivoting about screw and nuts sets 51' and 51". This will cause closure member 53" to uncover the opening (not shown) of tubular end 49. In this manner, the mixed cement paste flows out of tubular end 49 and further through guiding plate 60 into a predetermined small area, as illustrated in FIG. 11. FIG. 12 shows an application of this invention. Once the user finished dispensing the needed amount of cement mix into hole H1, he/she releases grip member 55', therefore spring rod 58 is pulled back to his original position and spring 58' returns to its unconstrained position, as seen in FIG. 3. Also closure 53" covers back the discharging port or opening of tubular end 49. Subsequently, the user transports device 10 aided by handle 48 and places it closer to hole H2, actuates again grip members 55 and 55' and dispenses cement mix into another hole H2, and so on. The mixed paste flow is achieved out of apparatus 10 also aided by rotational motion and lineal force impacted by device 20.

Once concluded the job, the user pours clean water into mixing chamber 43 and turns on trigger member 22 and switch 23 for elongated mixing shaft 36 to be driven in reverse rotary direction. Finally, the user disassembles apparatus 10 to deeply clean individual parts and mechanisms.

The foregoing description conveys the best understanding of the objectives and advantages of the present invention. Different embodiments may be made of the inventive concept of this invention. It is to be understood that all matter disclosed herein is to be interpreted merely as illustrative, and not in limiting sense.

What is claimed is:

1. A portable assembly for mixing water with cement powder and dispensing produced paste into a predetermined area, comprising:

a mixer assembly including a connecting rotating rod at one end and an elongated mixing shaft at the other end, and said mixer assembly is removable;

means for generating and transmitting a rotational motion to said connecting rotating rod of said mixer assembly;

a mixing body uprightly extending that has a mixing chamber including an upper opening and inner space defined by lateral walls and a bottom wall, and said mixing chamber further includes a tubular inlet rigidly mounted to the lowermost portion of said mixing chamber and adjacent to said bottom wall, and a tubular outlet rigidly mounted to the opposite lower portion of said mixing chamber and adjacent to said bottom wall, and wherein said elongated mixing shaft is inserted through said tubular inlet and housed within said mixing chamber, and said bottom wall has a C-shaped tubular configuration to provide enough space for said mixing shaft to freely rotate within; and a discharging mechanism having an actuating mechanism firmly mounted to said tubular outlet and a discharge closure assembly that in turn is pivotally mounted to the distal end of said tubular outlet, and said actuating mechanism including a fixed grip member rigidly mounted to said tubular outlet and a movable grip member firmly connected to a first and second elongated fork plates that in turn are connected to a spring rod assembly, and wherein said fixed and movable grip members respectively are configured to be manually actuated and thus said spring rod assembly in turn actuates and opens said discharge closure assembly so that the produced cement paste flows out into a predetermined area.

2. The portable assembly set forth in claim 1 wherein said elongated mixing shaft has a helical screw type configuration so that both supplied water and cement powder through said upper opening start mixing inside said inner space of said mixing chamber creating a circular movement up and down caused by the helical effect produced by said elongated mixing shaft.

3. The portable assembly set forth in claim 2 is horizontally and vertically supported with respect to a planar surface by a structure member, and wherein said structure member in turn rests on a horizontal surface by front and rear feet members.

4. The portable assembly set forth in claim 3 wherein said discharging mechanism further includes a guiding plate assembly removably mounted to said structure member and at an angle of inclination with respect to the ground level, and said guiding plate is configured to prevent the over spillage of the produced cement paste and guide the flow out through a mouth member.

5. The portable assembly set forth in claim 4 wherein said mixing body further includes a handle member rigidly mounted thereto so that said portable assembly is transported form one place to the other.

6. The portable assembly set forth in claim 5 is made out of a light weight metallic material to transport and easily manipulate the device while in use.

* * * * *